US007536143B2

(12) United States Patent
Funamoto

(10) Patent No.: US 7,536,143 B2
(45) Date of Patent: May 19, 2009

(54) METHOD AND APPARATUS FOR IMAGE FORMING FOR EFFECTIVELY ADJUSTING PHASE DIFFERENCES OF IMAGE BEARING MEMBERS

(75) Inventor: Noriaki Funamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 183 days.

(21) Appl. No.: 11/376,422

(22) Filed: Mar. 16, 2006

(65) Prior Publication Data

US 2006/0210325 A1 Sep. 21, 2006

(30) Foreign Application Priority Data

Mar. 17, 2005 (JP) ..... 2005-077602

(51) Int. Cl.
*G03G 15/01* (2006.01)

(52) U.S. Cl. ..... 399/301; 399/116; 399/299

(58) Field of Classification Search ..... 399/301, 399/299, 116; 347/116
See application file for complete search history.

(56) References Cited

U.S. PATENT DOCUMENTS

2003/0128995 A1* 7/2003 Ishii et al. ..... 399/49
2005/0058470 A1 3/2005 Funamoto et al.
2005/0084293 A1 4/2005 Fukuchi et al.
2006/0153590 A1* 7/2006 Igarashi ..... 399/116

FOREIGN PATENT DOCUMENTS

| | | |
|---|---|---|
| JP | 09-146329 | 6/1997 |
| JP | 2001-305820 | 11/2001 |
| JP | 2003-233235 | 8/2003 |
| JP | 2005-017768 | 1/2005 |

* cited by examiner

*Primary Examiner*—David M Gray
*Assistant Examiner*—Ryan D Walsh
(74) *Attorney, Agent, or Firm*—Harness, Dickey & Pierce PLC

(57) ABSTRACT

An image forming apparatus and corresponding method are disclosed. The apparatus includes at least one image bearing member configured to bear an image on a surface thereof, at least one drive member concentrically engaged with the at least one image bearing member corresponding thereto and configured to rotate the at least one image bearing member, and at least one detecting unit configured to detect a phase of the at least one drive member. In the image forming apparatus, the at least one drive member is adjusted to have a first phase difference arranged for a replacement of the at least one image bearing member. The first phase difference is different from a second phase difference arranged for an image forming operation.

17 Claims, 9 Drawing Sheets

METHOD AND APPARATUS FOR IMAGE FORMING FOR EFFECTIVELY ADJUSTING PHASE DIFFERENCES OF IMAGE BEARING MEMBERS

CROSS REFERENCE TO RELATED APPLICATIONS

The present patent application claims priority to Japanese patent application no. 2005-077602, filed in the Japan Patent Office on Mar. 17, 2005, the disclosure of which is incorporated by reference herein in its entirety.

BACKGROUND

1. Field

The present patent application generally relates to a method and/or apparatus for multicolor image forming. For example, at least one embodiment of the present patent application relates to an image forming apparatus, for example, a color copier and a color printer, for effectively adjusting phase differences of a plurality of image bearing members included in the image forming apparatus to reduce color shift caused by position shifts of the image bearing members.

2. Discussion of the Related Art

In an image forming apparatus using a plurality of image bearing members, a deviation caused by the fluctuation of a rotational speed of each image bearing member arises from tooth profile error of an image bearing member drive gear or an eccentricity of the image bearing member in mounting to the image forming apparatus, which contributes to color shifts when forming an overlaid image.

A well known technique for reducing color shifts of the image bearing member includes a method of matching a period of the fluctuation of a rotational speed of each image bearing member to minimize the amount of color shift so that an image having high quality can be produced.

To adjust the period of the fluctuation in the rotational speed of each image bearing member, there are some techniques, for example, proposed in Japanese Patent Laid-Open Application Publication Nos. 09-146329 and 2001-305820, that a pattern detecting part detects a color shift calibration pattern image formed by each of image bearing members to obtain a speed fluctuation period of each image bearing member and an amount of fluctuation of the rotational speed. Based on the speed fluctuation period and the amount of fluctuation of the rotational speed, a motor control part adjusts and controls the drive speed of a motor to detect phase differences between the image bearing members by the pattern detecting part. The information of the phase differences is stored as a profile into a volatile memory and is used to adjust phases between the image bearing members before image forming operations.

In this case, however, the amount of rotational speed deviation is obtained based on the speed fluctuation period by adding the speed fluctuation of an image bearing member drive gear to the speed fluctuation of the image bearing member. Therefore, the waveform of speed fluctuation of each image bearing member differs from each other according to the condition of engagement of the image bearing member drive gear and the image bearing member that have the same rotation period. Since the image bearing member is a consumable and is replaced on a regular basis by a user, it is difficult to tell how the user engages the image bearing member with the image bearing member drive gear during maintenance and/or replacement of the image bearing member.

Further, there is another technique, for example, proposed in Japanese Patent Laid-Open Application Publication No. 2003-233235, that utilized in a color image forming apparatus that includes a pattern forming unit, a rotational phase detecting unit, a phase adjusting unit, and a phase information storing unit. In the color image forming apparatus, the pattern forming unit forms a positional deviation detecting pattern on a carrying member. The rotational phase detecting unit adjusts the rotational phase of a detection color at every prescribed angle with reference to a reference color in the positional deviation detecting pattern formed on the carrying member so that the reference color and the detection color can be simultaneously detected, and then, calculates the positional deviation of the detection color from the reference-color and the optimum rotational phase of the uneven angular velocity of the image bearing member required to reduce the positional deviation to the minimum. The phase adjusting unit adjusts the rotational phase.

The phase information storing unit stores the rotational phase information determined by the rotational phase detecting unit. Then, the rotational phase is adjusted by the rotational phase detecting unit so that the positional deviation may become the minimum. The determined rotational phase information is stored at a manufacturing stage before the delivery from the factory.

Further, there is another technique, for example, proposed in Japanese Patent Laid-Open Application Publication No. 2005-017768, that is in a multi-color image forming apparatus equipped with a plurality of image stations, a plurality of exposing devices, and a control unit. The plurality of image stations include an image carrier, a plurality of image bearing members to be brought into contact with the image carrier at the time of image formation to a recording medium, and a toner developing device which elicits latent images formed on the image bearing members as toner images. The plurality of exposing devices irradiates light to each of the image bearing member and forms the latent image.

The control unit performs control of adjusting phase difference between the respective image bearing members. The control unit includes an electrostatic latent image measurement unit for measuring the latent images formed on the respective image bearing members, a rotational fluctuation measurement unit for measuring rotational fluctuation of the respective image bearing members based on a detection result detected by the electrostatic latent image measurement unit, and a phase difference measurement unit for measuring the phase difference between the respective image bearing member based on a measurement result measured by the rotational fluctuation measurement unit. With the above-described structure, rotational speed of the image bearing members is changed based on a detection result detected by the phase difference measurement unit.

SUMMARY

Embodiments of the present patent application has been made, taking the above-mentioned circumstances into consideration.

An object of at least one embodiment of the present patent application is to provide an image forming apparatus that can easily adjust phase differences of a plurality of image bearing members to reduce color shifts caused by position shifts of the plurality of image bearing members.

Another object of at least one embodiment of the present patent application is to provide a method of adjusting phase differences of the plurality of image bearing members included in the above-described novel image forming apparatus.

In one embodiment, a novel image forming apparatus includes at least one image bearing member configured to bear an image on a surface thereof, at least one drive member concentrically engaged with the at least one image bearing member corresponding thereto and configured to rotate the at least one image bearing member, and at least one detecting unit configured to detect a phase of the at least one drive member. In the novel image forming apparatus, the at least one drive member may be adjusted to have a first phase difference arranged for a replacement of the at least one image bearing member. The first phase difference may be different from a second phase difference arranged for an image forming operation.

The at least one image bearing member may include a plurality of image bearing members. The at least one drive member may include a plurality of drive members corresponding to the plurality of respective image bearing members. The at least one detecting unit may include a plurality of detecting units corresponding to the plurality of respective drive members. The plurality of drive members may be adjusted to have the first phase difference for the replacement and the second phase difference for the image forming operation.

The above-described novel image forming apparatus may further include a plurality of markings, each of which configured to indicate one of maximum and minimum peak positions of a fluctuation in a rotation speed of the at least one drive member.

Respective fluctuations in respective rotational speeds of the plurality of drive members may be measured by a measuring unit before shipping.

The respective fluctuations in the respective rotational speeds of the plurality of drive members may become identical in phase to each other for the replacement of the at least one image bearing member.

The respective fluctuations in the respective rotational speeds of the plurality of image bearing members may be measured by a measuring unit before shipping.

The plurality of image bearing members may include respective markings. Each of which are configured to indicate one of maximum and minimum peak positions of a fluctuation in a rotation speed of the at least one image bearing member.

The plurality of drive members may be configured to be adjusted to have the first phase difference for the replacement such that one of the maximum and minimum peak positions of the fluctuation in the rotational speed of the at least one drive member may fit with one of the maximum and minimum peak positions of the fluctuation in the rotational speed of the at least one image bearing member.

Each of the plurality of image bearing members may be included in a process cartridge corresponding thereto.

The first phase difference different from the second phase difference may be selected through an operation panel provided to the image forming apparatus when the at least one of the plurality of image bearing member is replaced.

The first phase difference different from the second phase difference may be selected via buttons provided inside a cover of the image forming apparatus when the at least one of the plurality of image bearing member is replaced.

The first and second phase differences may be automatically changed along with a movement of a cover of the image forming apparatus when the at least one of the plurality of image bearing member is replaced.

Further, in one embodiment, a novel method of adjusting a phase difference of an image bearing member of an image forming apparatus includes the steps of opening a cover of the image forming apparatus, rotating a drive member to adjust a first phase difference thereof arranged for a replacement of the image bearing member, replacing the image bearing member to a new image bearing member, closing the cover of the image forming apparatus, and changing the drive member to adjust a second phase difference thereof arranged for an image forming operation.

The rotating and changing steps may include one of the steps of controlling the phase difference through an operation panel provided to the image forming apparatus, controlling the phase difference through buttons provided inside the cover of the image forming apparatus, and automatically changing the phase difference with a movement of the cover of the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXAMPLE EMBODIMENTS

Figure 1:
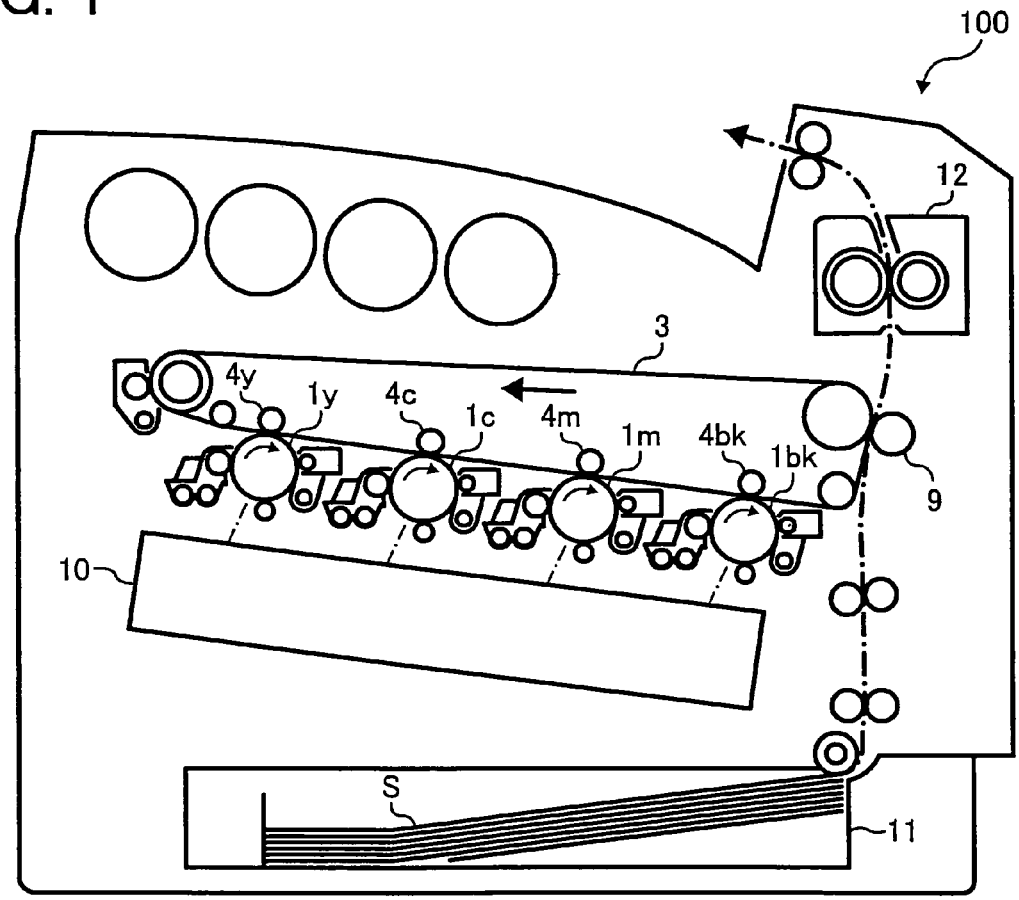
FIG. 1 is a schematic structure of a color image forming apparatus according to an example embodiment of the present patent application.

In describing example embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views, example embodiments of the present patent application are described.

Referring to FIG. 1, a schematic structure of a color image forming apparatus 100 according to an example embodiment of the present patent application is described. And referring to FIG. 2, an enlarged view of an image forming portion of the color image forming apparatus 100 of FIG. 1 is described.

In FIG. 1, the color image forming apparatus 100 includes a plurality of photoconductive drums 1*y*, 1*c*, 1*m*, and 1*bk*, an intermediate transfer belt 3, a plurality of primary transfer rollers 4*y*, 4*c*, 4*m*, and 4*bk*, a secondary transfer roller 9, an optical writing unit 10, a sheet feeding cassette 11 including a transfer sheet S serving as a recording medium, and a fixing unit 12.

Figure 2:
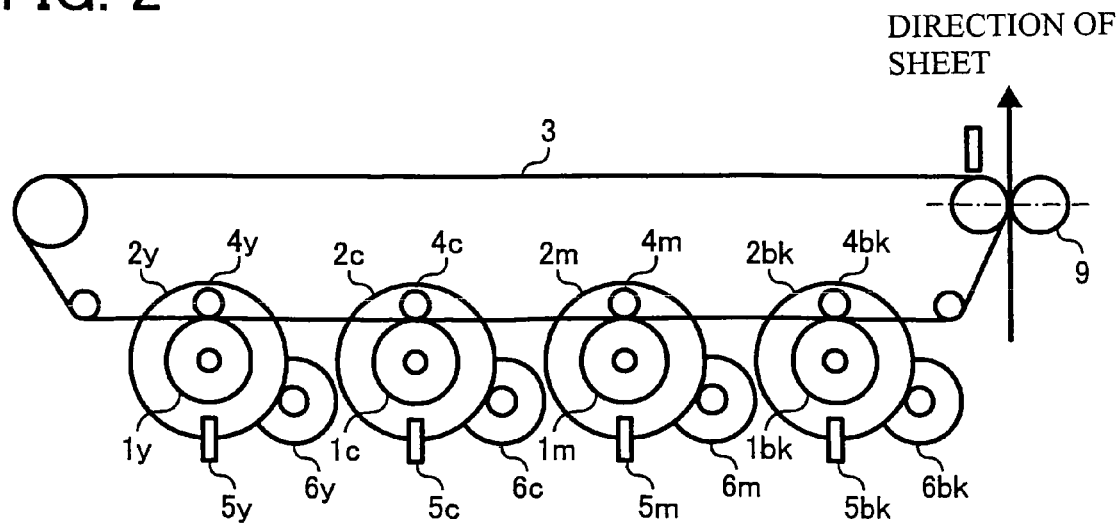
FIG. 2 is an image forming part of the color image forming apparatus of FIG. 1.

In FIG. 2, the image forming portion includes the plurality of photoconductive drums 1*y*, 1*c*, 1*m*, and 1*bk*, a plurality of photoconductive drum drive gears 2*y*, 2*c*, 2*m*, and 2*bk*, a plurality of phase difference detecting units 5*y*, 5*c*, 5*m*, and 5*bk*, and a plurality of drive motors 6*y*, 6*c*, 6*m*, and 6*bk*.

The plurality of photoconductive drums 1*y*, 1*c*, 1*m*, and 1*bk* serve as image bearing members, and perform image forming operations for producing respective toner images with toners of different colors of yellow (y), magenta (m), cyan (c), and black (bk).

The plurality of respective photoconductive drums 1*y*, 1*c*, 1*m*, and 1*bk* are separately arranged at positions having different heights in a stepped manner and are detachably provided to the color image forming apparatus 100 so that each of the plurality of photoconductive drums 1*y*, 1*c*, 1*m*, and 1*bk* can be replaced at once at an end of its useful life.

Each of the photoconductive drums 1*y*, 1*c*, 1*m*, and 1*bk* is a rotating member including a cylindrical conductive body having a relatively thin base. Each of the photoconductive drums 1*y*, 1*c*, 1*m*, and 1*bk* is driven by a rotation drive unit (not shown) and is rotated clockwise in FIG. 1. Each of the photoconductive drums 1*y*, 1*c*, 1*m*, and 1*bk* is rotated while contacting the surface of the intermediate transfer belt 3.

The plurality of photoconductive drum drive gears 2*y*, 2*c*, 2*m*, and 2*bk* serve as drive members to rotate the plurality of photoconductive drums 1*y*, 1*c*, 1*m*, and 1*bk*, respectively. The plurality of photoconductive drum drive gears 2*y*, 2*c*, 2*m*, and 2*bk* are concentrically engaged with the plurality of respective photoconductive drums 1*y*, 1*c*, 1*m*, and 1*bk*, respectively.

The plurality of drive motors 6*y*, 6*c*, 6*m*, and 6*bk* are disposed in the vicinity of the plurality of photoconductive drum drive gears 2*y*, 2*c*, 2*m*, and 2*bk*, respectively. The plurality of drive motors 6*y*, 6*c*, 6*m*, and 6*bk* serve as drive units to drive the plurality of photoconductive drum drive gears 2*y*, 2*c*, 2*m*, and 2*bk* to rotate so that the plurality of respective photoconductive drums 1*y*, 1*c*, 1*m*, and 1*bk* can be rotated, respectively.

The intermediate transfer belt 3 is disposed at a position above the plurality of photoconductive drums 1*y*, 1*c*, 1*m*, and 1*bk*. The intermediate transfer belt 3 forms an endless belt extending over a plurality of supporting rollers including the plurality of primary transfer rollers 4*y*, 4*c*, 4*m*, and 4*bk*, and rotating counterclockwise as indicated by an arrow in FIG. 1. The intermediate transfer belt 3 is held in contact with the plurality of primary transfer rollers 4*y*, 4*c*, 4*m*, and 4*bk* serving as a primary transfer mechanism and corresponding to the plurality of photoconductive drums 1*y*, 1*c*, 1*m*, and 1*bk*, respectively, to form primary transfer nips between the photoconductive drum 2*y* and the primary transfer roller 4*y*, between the photodonductive drum 2*c* and the primary transfer roller 4*c*, and so forth.

The plurality of phase difference detecting units 5*y*, 5*c*, 5*m*, and 5*bk* are disposed facing one edge in a width wide direction of the circumference of each of the photoconductive drum drive gears 2*y*, 2*c*, 2*m*, and 2*bk*. The plurality of phase difference detecting units 5*y*, 5*c*, 5*m*, and 5*bk* are sensors or detecting members, and detect respective phase differences of the plurality of photoconductive drum drive gears 2*y*, 2*c*, 2*m*, and 2*bk*.

The secondary transfer roller 9 is disposed facing one of the supporting rollers extending the intermediate transfer belt 3, sandwiching the intermediate transfer belt 3. A secondary nip holding a predetermined nip pressure is formed between the secondary transfer roller 9 and the one of the supporting rollers.

The optical writing unit 10 is disposed at a portion below the plurality of photoconductive drums 1*y*, 1*c*, 1*m*, and 1*bk*. The optical writing unit 10 emits respective laser beams including a laser beam L towards the plurality of photoconductive drums 1*y*, 1*c*, 1*m*, and 1*bk*.

The sheet feeding cassette 11 serving as a sheet feeding mechanism accommodates a plurality of recording media such as transfer sheets that include an individual transfer sheet S.

The fixing unit 12 is disposed at the upper right portion of the color image forming apparatus 100 in FIG. 1. The fixing unit 12 fixes a full color toner image to the transfer sheet S by applying heat and pressure.

The color image forming apparatus 100 also includes a controlling unit (not shown). The controlling unit performs adjusting operations of respective phase differences of the photoconductive drum drive gears 2*y*, 2*c*, 2*m*, and 2*bk* by changing respective rotational speeds of the plurality of drive motors 6*y*, 6*c*, 6*m*, and 6*bk* based on the results obtained by the plurality of phase difference detecting units 5*y*, 5*c*, 5*m*, and 5*bk* or by changing respective rotation start and stop times for the plurality of drive motors 6*y*, 6*c*, 6*m*, and 6*bk*, respectively.

The photoconductive drums 1*y*, 1*c*, 1*m*, and 1*bk* can be incorporated in respective process cartridge (not shown) with other image forming components disposed around the respective photoconductive drums 1*y*, 1*c*, 1*m*, and 1*bk*. Each process cartridge can be detachably disposed in the color image forming apparatus 100. For example, each detachable process cartridge can integrally include each of the photoconductive drums 1*y*, 1*c*, 1*m*, and 1*bk*, and the corresponding image components, for example, a charging unit (not shown), and a developing unit (not shown). Further, the detachable process cartridge may further integrally include a sheet conveying unit (not shown), a discharging unit (not shown), a photoconductive drum cleaning unit (not shown) and so forth, if needed, as optional image forming components.

Figure 3:
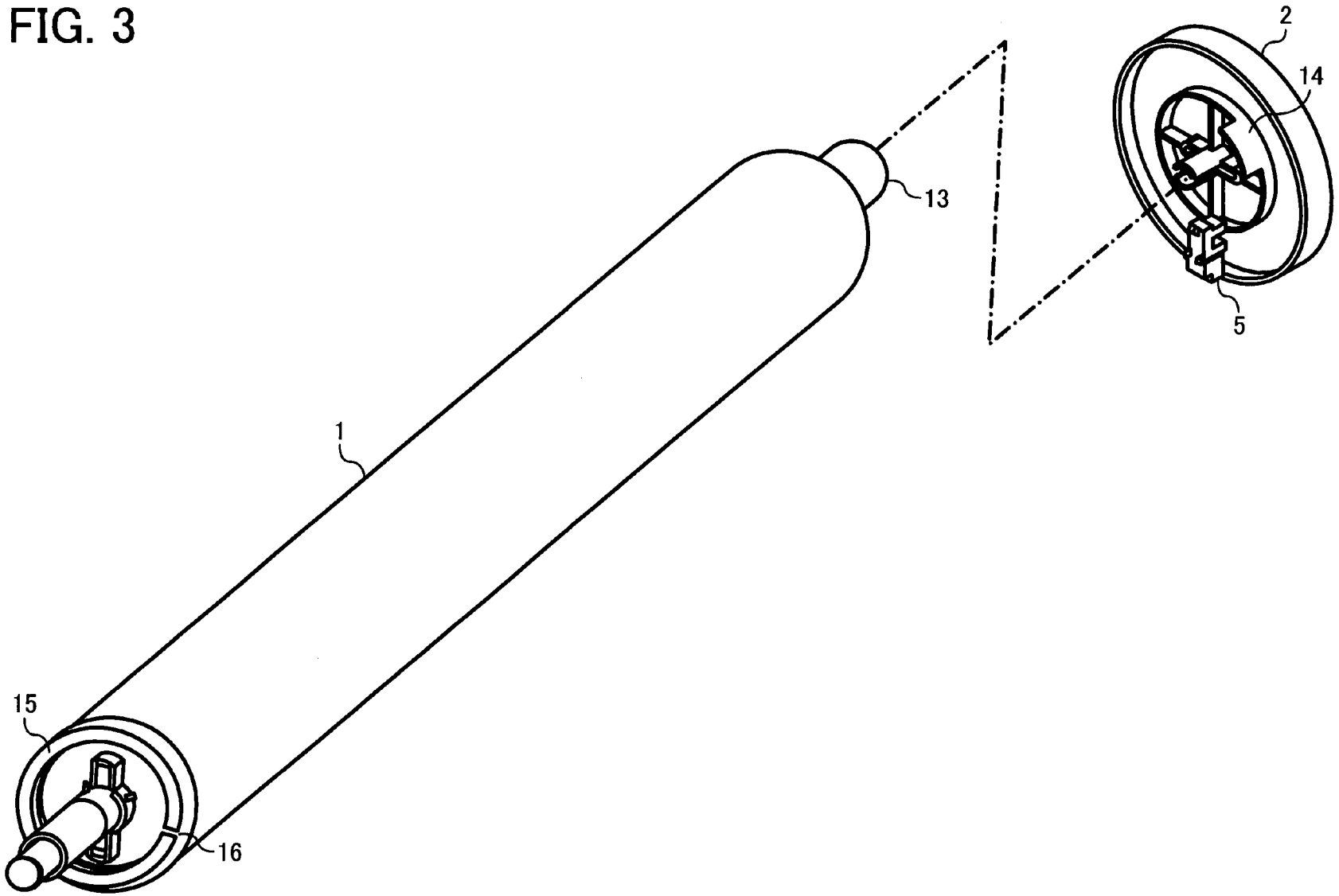
FIG. 3 is a perspective view of an image bearing member and an image bearing member drive gear mounted to the image forming apparatus of FIG. 2.
Figure 12:
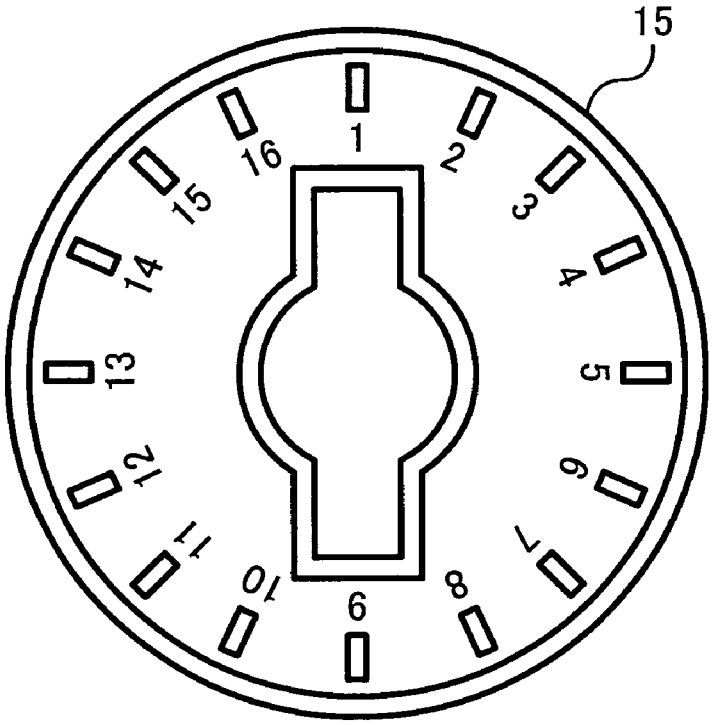
FIG. 12 is a front view of a drum flange attached to the image bearing member.

Since the above described components indicated by y, c, m, and bk used for the image forming operations have similar structures and functions, except that respective toner images formed thereon are of different colors, which are yellow, magenta, cyan, and black toners, the discussion in FIGS. 3 and 12 uses reference numerals for specifying components of the color image forming apparatus 100 without suffixes of colors such as y, m, c, and bk.

Referring to FIG. 3, schematic structures of the photoconductive drum 1 and the photoconductive drum drive gear 2 are described.

As previously described, the photoconductive drum drive gear 2 serves as a drive member and is configured to concentrically be engaged with the photoconductive drum 1.

The photoconductive drum drive gear 2 has a portion formed as a marking 14. The marking 14 is used when the phase difference detecting unit 5 detects a position of the photoconductive drum drive gear 2. Based on an output indicating the position of the photoconductive drum drive gear 2, a phase difference of the photoconductive drum drive gear 2 can be obtained so that a phase difference of the photoconductive drum 1 can be adjusted.

As previously described, the photoconductive drum 1 includes a cylindrical conductive body supported by a shaft (not shown) that runs in a longitudinal direction of the photoconductive drum 1. A drum flange 15 is disposed at one end of the photoconductive drum 1, and a gear 13 is disposed at the other end. The drum flange 15 includes a marking 16 that indicates one of maximum and minimum peaks of an individual photoconductive drum. When replacing a used photoconductive drum to a new photoconductive drum, a user can adjust the fluctuation in the rotational speed of the new photoconductive drum by setting the phase difference of the new photoconductive drum to a specific number that is printed on a box containing the new photoconductive drum or is written on a sheet enclosed in the box containing the new photoconductive drum or on a portion of the new photoconductive drum. The gear 13 attached to the shaft of the photoconductive drum 1 is engaged with the corresponding photoconductive drum drive gear 2 to cause the photoconductive drum 1 and the photoconductive drum drive gear 2 to concentrically rotate together.

Figure 4A:
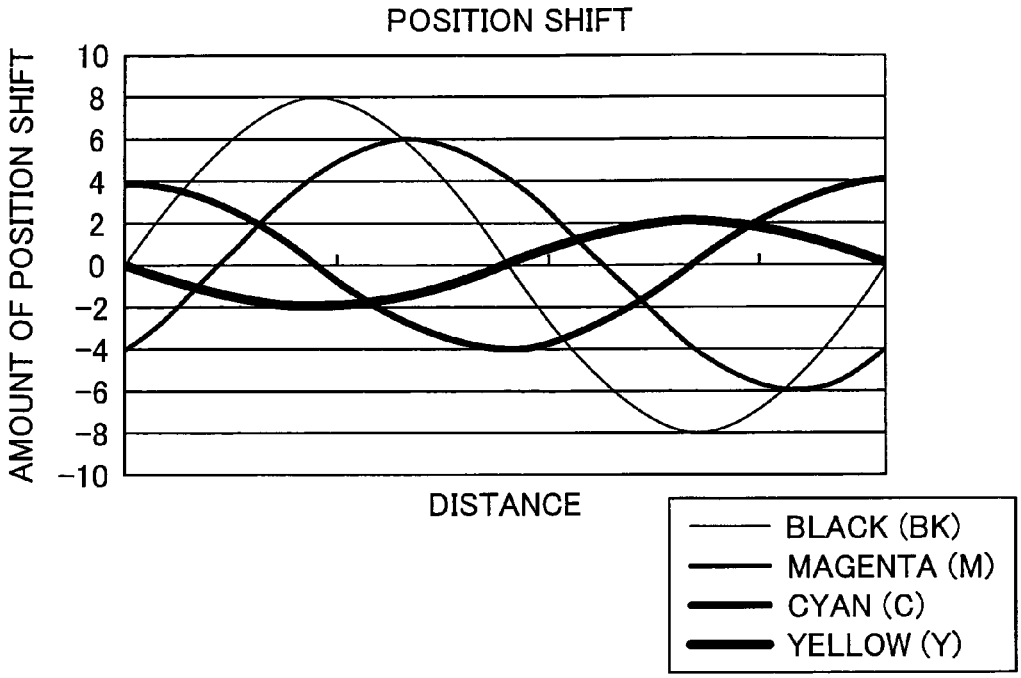
FIG. 4 is a graph showing position shifts of the image bearing members by distance.
FIG. 4B is a graph showing color shifts caused by the position shifts of F*igure* 4A.
Figure 4B:
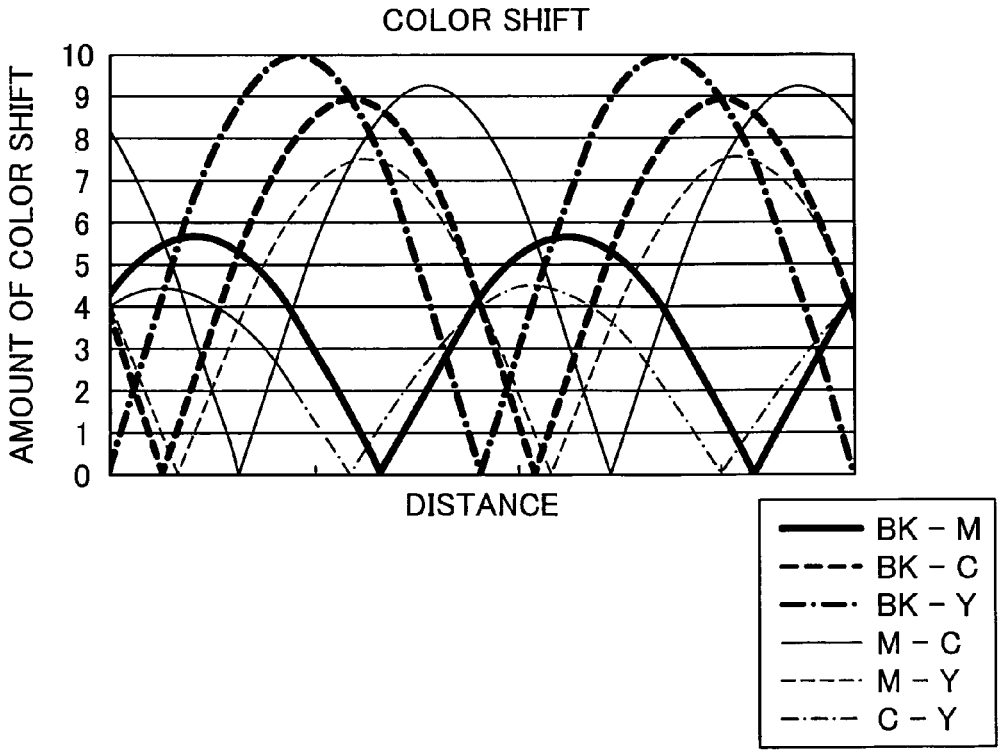

Referring to FIGS. 4A and 4B, graphs show deviations or position shifts of the fluctuation in the rotational speed of each photoconductive drum 1 and color shifts caused by the position shifts in the color image forming apparatus 100.

FIG. 4A shows the position shifts having the fluctuations in the rotational speeds between the plurality of photoconductive drums 1*y*, 1*c*, 1*m*, and 1*bk*, which may be a cause of an occurrence of the color shifts as shown in FIG. 4B. Respective fluctuations of the rotational speeds in one rotation period of the respective photoconductive drums 1*y*, 1*c*, 1*m*, and 1*bk* can occur due to a tooth profile error of the photoconductive drum drive gear 2 and/or eccentricity or off-centering of the photoconductive drum 1 when replacing even when the photoconductive drum drive motors 6 rotate at a constant velocity. The above-described condition may be a big issue that can contribute to a significant effect on the color shift.

Figure 5A:
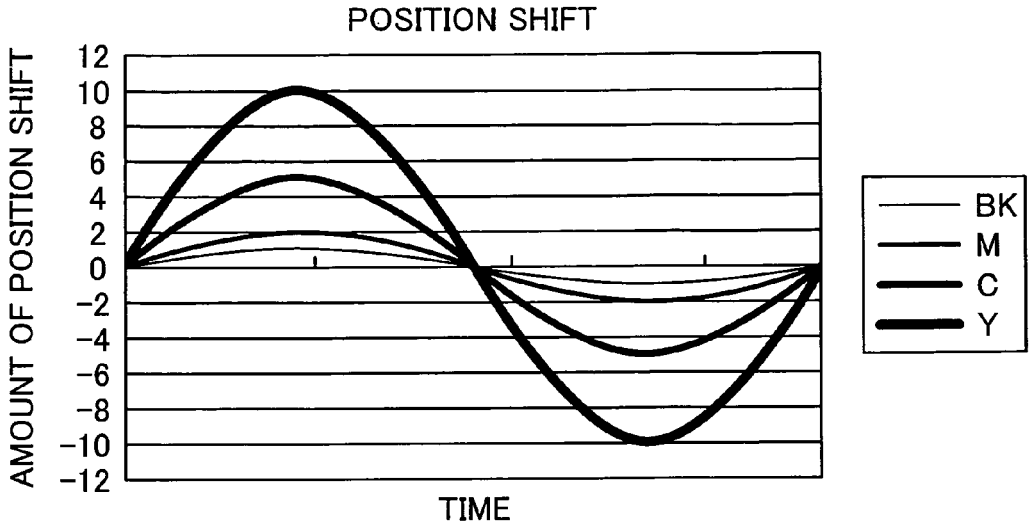
FIG. 5A is a graph showing position shifts of the image bearing members by time.
Figure 5B:
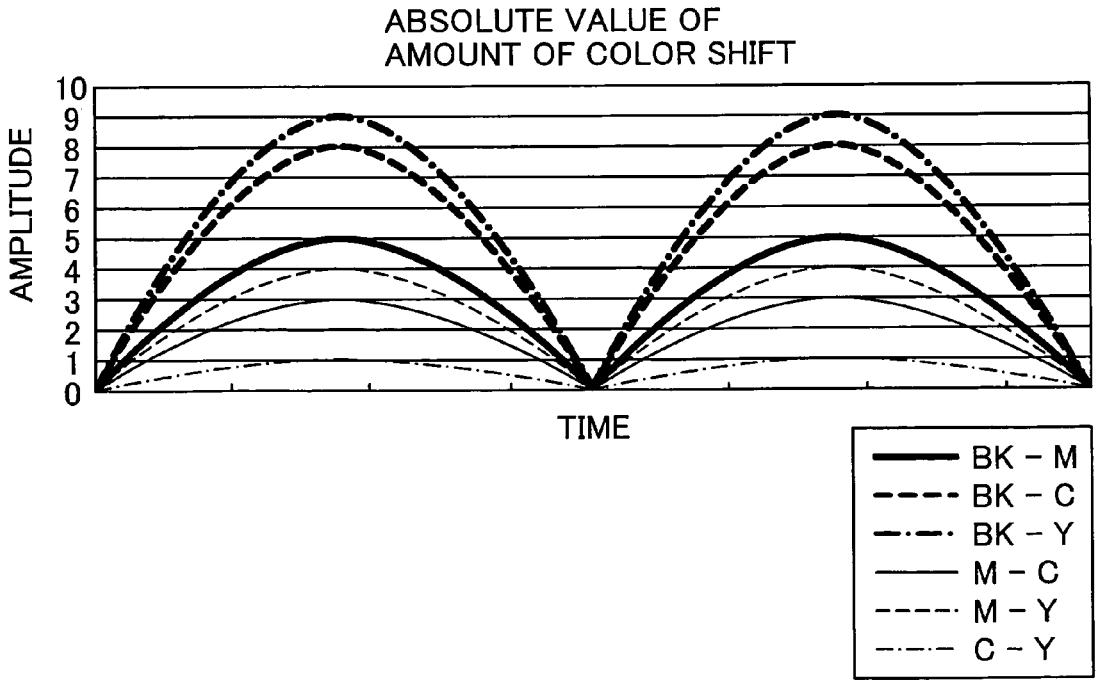
FIG. 5B is a graph showing absolute color shifts among the image bearing members.

To prevent the above-described problems, for example, toner images of color shift correction patterns have been formed on an intermediate transfer belt or a recording medium, and respective sensors provided in the image forming apparatus have read the toner image for correction. Based on the results obtained by the respective sensors, respective drive motors control respective movements of a plurality of photoconductive drums so that the fluctuations in the rotational speeds of each photoconductive drum having different colors can obtain phase differences between the plurality of photoconductive drums 1 as shown in FIGS. 5A and 5B.

That is, the movements of the plurality of photoconductive drums 1*y*, 1*c*, 1*m*, and 1*bk*, or the phase differences between the plurality of photoconductive drums 1*y*, 1*c*, 1*m*, and 1*bk*, are controlled to have a least amount of deviation caused by the fluctuation in the rotational speed of the respective photoconductive drums 1*y*, 1*c*, 1*m*, and 1*bk*. Thus, high quality images having less color shifts have been produced. Since the above-described process performing in a range from detecting phase difference of each photoconductive drum 1 to controlling the phase difference is well known in the art, the details of the process are omitted.

As previously described, the fluctuation of the rotational speed in one rotation period of each of the photoconductive drums 1*y*, 1*c*, 1*m*, and 1*bk* is measured as described above, which represents that the fluctuation in the rotational speed can be caused due to a nature of each of the photoconductive drum drive gears 2*y*, 2*c*, 2*m*, and 2*bk*. However, the factors generating fluctuations in the rotational speeds of the photoconductive drums 1*y*, 1*c*, 1*m*, and 1*bk* are not limited to the nature or attribute of the photoconductive drum driver gears 2*y*, 2*c*, 2*m*, and 2*bk*. That is, the fluctuation in the rotational speed of each of the photoconductive drums 1*y*, 1*c*, 1*m*, and 1*bk* can also be caused by a nature of respective members corresponding to the detachable photoconductive drums 1*y*, 1*c*, 1*m*, and 1*bk* and/or an action or condition of engaging and replacing consumable photoconductive drums 1*y*, 1*c*, 1*m*, and 1*bk* detachably disposed to the image forming apparatus 100.

More specifically, the fluctuation in the rotational speed of each of the photoconductive drums 1*y*, 1*c*, 1*m*, and 1*bk* can be caused due to eccentricity of an engaging member that engages a corresponding one of the photoconductive drums 1*y*, 1*c*, 1*m*, and 1*bk* with a corresponding one of the photoconductive drum drive gears 2*y*, 2*c*, 2*m*, and 2*bk*. The fluctuation of rotational speed in one rotation period of each of the photoconductive drums 1*y*, 1*c*, 1*m*, and 1*bk* having the above-described two factors may form different composed waves of the fluctuation in the rotational speed according to the conditions of engagement or positioning between the photoconductive drum 1 and the photoconductive drum drive gear 2, as shown in FIGS. 6 and 7.

Therefore, when at least one of the photoconductive drums 1*y*, 1*c*, 1*m*, and 1*bk* is replaced with a new photoconductive drum for maintenance or at the end of its life, the fluctuations in the rotational speeds between the at least one of photoconductive drums 1*y*, 1*c*, 1*m*, and 1*bk* and the new photoconductive drum may vary. That is, the fluctuation in the rotational speed of a photoconductive drum may change before and after the replacement, and therefore, the phase relationships of the respective photoconductive drums 1*y*, 1*c*, 1*m*, and 1*bk* can not be keep with a least fluctuation value of the rotational speed of the photoconductive drums 1*y*, 1*c*, 1*m*, and 1*bk*.

Further, since each of the photoconductive drums 1*y*, 1*c*, 1*m*, and 1*bk* and a corresponding one of the photoconductive drum drive gears 2*y*, 2*c*, 2*m*, and 2*bk* are not integrally formed but engaged by an engaging member as shown in FIG. 3, the photoconductive drums 1*y*, 1*c*, 1*m*, and 1*bk* and the corresponding photoconductive drum drive gears 2*y*, 2*c*, 2*m*, and 2*bk* may have different fluctuations of the rotational speeds. That is, the phase of each of the photoconductive drums 1*y*, 1*c*, 1*m*, and 1*bk* can become different from the phase of each of the photoconductive drum drive gears 2*y*, 2*c*, 2*m*, and 2*bk* when any one of the photoconductive drums 1*y*, 1*c*, 1*m*, and 1*bk* is replaced and engaged with the corresponding one of the photoconductive drum drive gears 2*y*, 2*c*, 2*m*, and 2*bk*.

Figure 6:
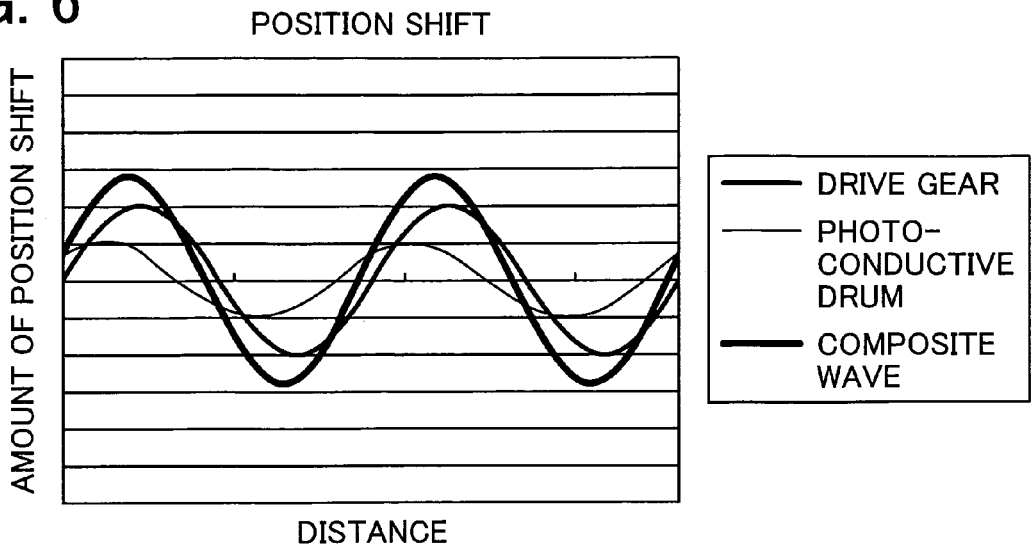
FIG. 6 is a graph showing a relationship of position shifts of the image bearing member drive gear and the image bearing member.
Figure 7:
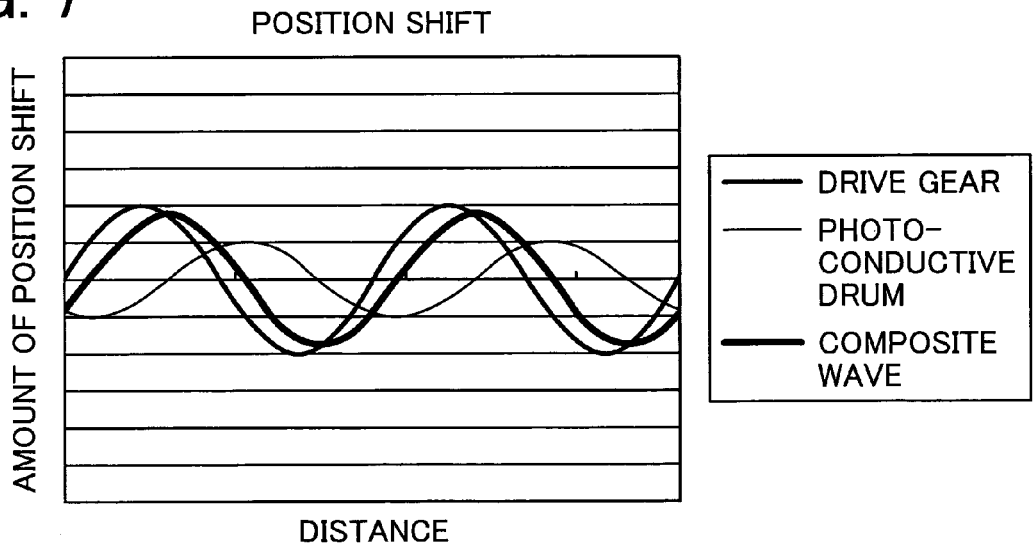
FIG. 7 is a graph showing another relationship of position shifts of the image bearing member drive gear and the image bearing member.

More specifically, since the phases of the photoconductive drums 1*y*, 1*c*, 1*m*, and 1*bk* and those of the photoconductive drum drive gears 2*y*, 2*c*, 2*m*, and 2*bk* corresponding to the photoconductive drums 1y, 1c, 1m, and 1bk are different, composite waves can have different amounts of phases and deviations depending on the engaging conditions, and the phase and amplitude of position shifts can be different, examples of which are shown in FIG. 6 and FIG. 7.

Therefore, when any one of the photoconductive drums 1y, 1c, 1m, and 1bk is replaced, it is preferable that the phase of a new photoconductive drum replaced with any one of the photoconductive drums 1y, 1c, 1m, and 1bk is adjusted once again after the replacement of the new photoconductive drum to prevent color shift in image. However, the adjustment of the phase after the replacement of the new photoconductive drum usually takes a long time, which may cause a user to wait for a long time until the image forming apparatus 100 becomes ready to start the image forming operation again.

Figure 8:
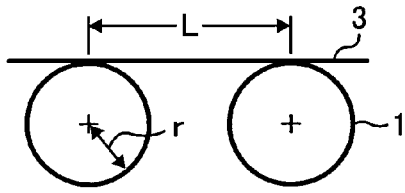
FIG. 8 is a drawing illustrating two image bearing members adjacent to each other for adjusting respective rotational speed variations of the image bearing members.

To avoid the above-described inconvenience to the user and to further prevent color shifts in image formed on the intermediate transfer belt 3 or a recording medium, it is preferable that respective fluctuations in the rotational speeds of the photoconductive drum drive gears 2y, 2c, 2m, and 2bk are identical in phase so that respective fluctuations in the rotational speeds of the photoconductive drums 1y, 1c, 1m, and 1bk correspond to each other. For example, assuming an image forming apparatus has a structure as shown in FIG. 8. The peak position of the fluctuation in the rotational speed of a photoconductive drum preferably has a difference that is equal to an amount satisfying $\theta$ [rad]=L/r per station, with respect to the photoconductive drum specified for a reference color, where "r" represents a radius (mm) of the photoconductive drum 1 and "L" represents a distance (mm) between image forming stations or units. To reduce the color shift, the photoconductive drum drive motors 6y, 6c, 6m, and 6bk control the rotational speeds of the photoconductive drums 1y, 1c, 1m, and 1bk so that the phase differences of the photoconductive drums 1y, 1c, 1m, and 1bk can be adjusted to be optimal respectively.

When one of the photoconductive drums 1y, 1c, 1m, and 1bk is replaced under the condition in which the photoconductive drums 1y, 1c, 1m, and 1bk have the above-described optimal phase differences; the fluctuation of the rotational speed for the replaced photoconductive drum may be changed. Since each of the photoconductive drums 1y, 1c, 1m, and 1bk has its unique value of the absolute or peak position of the fluctuation in the rotational speed, it is difficult for the new photoconductive drum to have the fluctuation of the rotational speed same as the previously used photoconductive drum before the replacement.

Figure 9A:
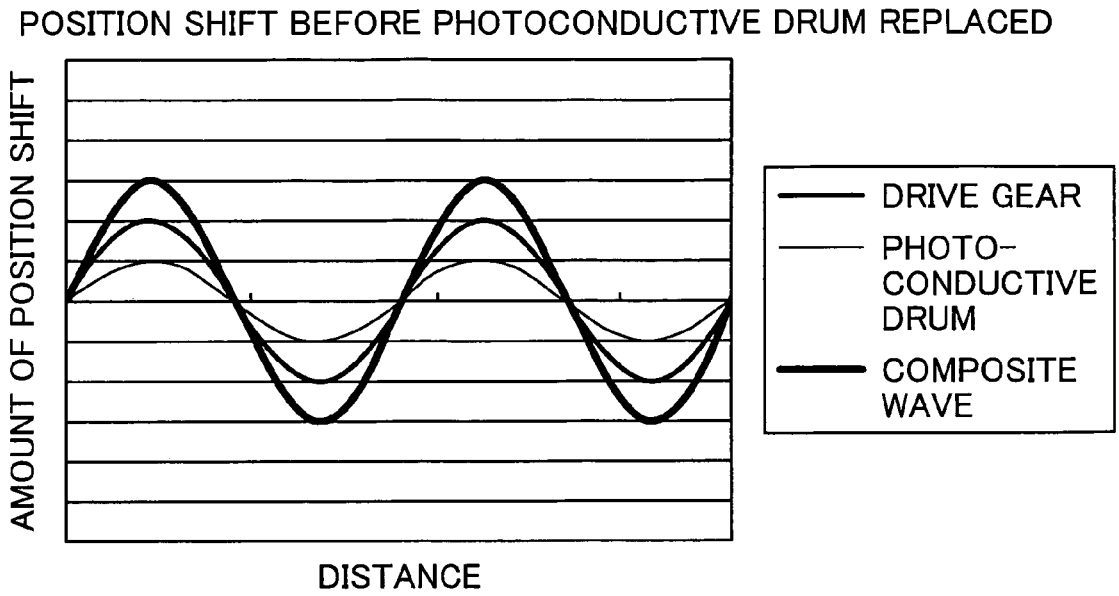
FIG. 9A is a graph showing position shifts before a replacement of the image bearing member.
Figure 9B:
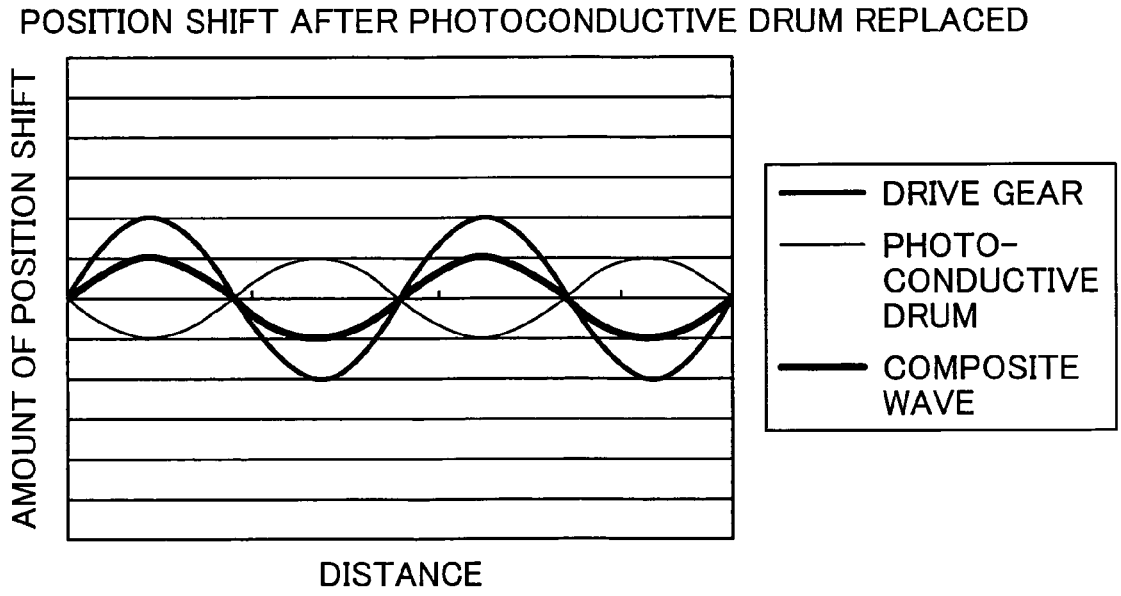
FIG. 9B is a graph showing position shifts after the replacement of the image bearing member.

Referring to FIGS. 9A and 9B, graphs show the phase differences of one of the photoconductive drums 1y, 1c, 1m, and 1bk before and after the replacement.

As shown in FIGS. 9A and 9B, when respective amplitude differences of the fluctuations in the rotational speeds of any one of the photoconductive drums 1y, 1c, 1m, and 1bk are significantly changed between the used photoconductive drums 1y, 1c, 1m, and 1bk used before the replacement and that used after the replacement, amplitude differences between the plurality of photoconductive drums mounted in the image forming apparatus 100 may change, thereby the color shift may not be reduced even after the phase of the photoconductive drum 1 1y, 1c, 1m, and 1bk is adjusted.

To avoid the above-described circumstance, values of fluctuations in the rotational speeds of the photoconductive drum drive gears 2y, 2c, 2m, and 2bk are previously obtained in the process of assembling the image forming apparatus 100. The measurement is carried out by using a measuring instrument (not shown) that is used to measure characteristic values of the photoconductive drums 1y, 1c, 1m, and 1bk and/or the photoconductive drum drive gears 2y, 2c, 2m, and 21bk. The drive motors 6 control the photoconductive drum drive gears 2y, 2c, 2m, and 2bk according to the measured fluctuations.

When the photoconductive drums 1y, 1c, 1m, and 1bk are used in an image forming operation, the photoconductive drums 1y, 1c, 1m, and 1bk have respective phase differences which are not identical. That is, the photoconductive drum drive gears 2y, 2c, 2m, and 2bk are controlled to have phase differences in which the respective fluctuations of the photoconductive drums 1y, 1c, 1m, and 1bk are not identical in phase so that toner images formed on the photoconductive drums 1y, 1c, 1m, and 1bk can be sequentially transferred onto the intermediate transfer belt 3. The phase differences of the photoconductive drums 1y, 1c, 1m, and 1bk for the image forming operation are hereinafter referred to as a "phase difference for an image forming operation."

On the other hand, when any one of the photoconductive drums 1y, 1c, 1m, and 1bk is replaced to a new photoconductive drum, the photoconductive drum drive gears 2y, 2c, 2m, and 2bk are controlled to rotate to stop at a predetermined position in which the phase differences of the photoconductive drum drive gears 2y, 2c, 2m, and 2bk are identical. That is, the photoconductive drum drive gears 2y, 2c, 2m, and 2bk are controlled to have the phase differences when replacing a photoconductive drum so that the phase differences of the photoconductive drums 1y,1c, 1m, and 1bk are also identical. The phase differences of the photoconductive drums 1y, 1c, 1m, and 1bk for the drum replacing operation are hereinafter referred to as a "phase difference for a drum replacement."

Now, as previously described, when any one of the photoconductive drums 1y, 1c, 1m, and 1bk is replaced, it is preferable to adjust the phase differences of the photoconductive drums 1y, 1c, 1m, and 1bk once again. With the previously measured values of fluctuations in the rotational speeds of the photoconductive drum drive gears 2y, 2c, 2m, and 2bk, the adjustment can easily performed. In addition to the previously measured values of the fluctuation, the arrangement of the photoconductive drum drive gears 2y, 2c, 2m, and 2bk can allow the user to easily perform the replacement of the photoconductive drum.

More specifically, when the photoconductive drum drive gears 2y, 2c, 2m, and 2bk are in the phase difference for the drum replacement, the peak position of the fluctuations in the rotational speeds of the respective photoconductive-drum drive gears 2y, 2c, 2m, and 2bk are controlled to come to respective optimal positions.

Figure 10A:
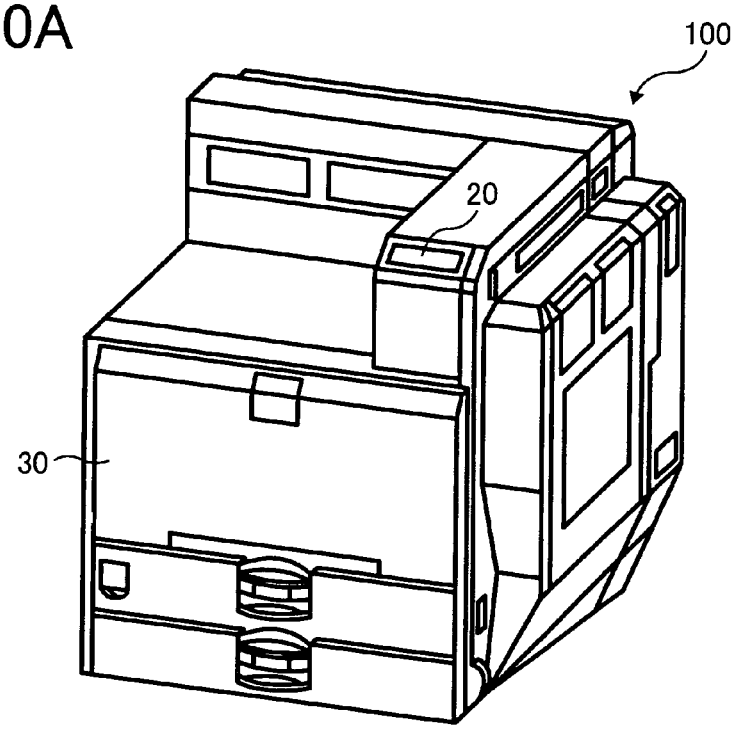
FIG. 10A is a perspective view of the image forming apparatus when the front cover of the image forming apparatus is closed.
Figure 10B:
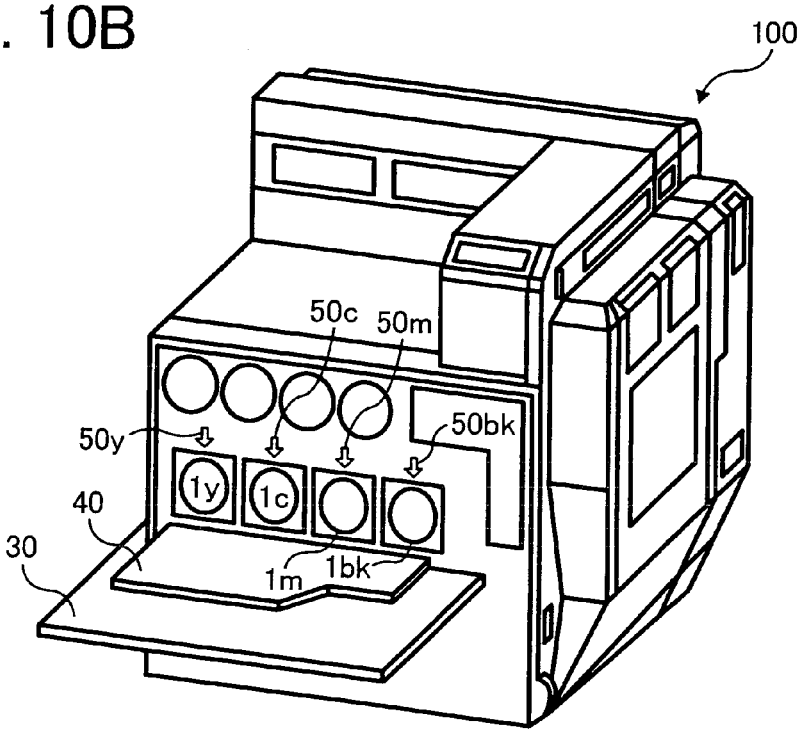
FIG. 10B is a perspective view of the image forming apparatus when the front cover is open.

Referring to FIGS. 10A and 10B, a schematic structure of the image forming apparatus 100 is described.

To adjust the phase differences of the photoconductive drum drive gears 2y, 2c, 2m, and 2bk, a user also performs some operations. When the user selects a replacement of any one of the photoconductive drums 1y, 1c, 1m, and 1bk, for example, by pressing a button displayed or formed on an operation panel 20 of the image forming apparatus 100 shown in FIG. 10A, the plurality of photoconductive drums 1y, 1c, 1m, and 1bk having the phase differences for the image forming operation are controlled to move to their optimal positions having the phase differences for the drum replacement. Since the peak positions of the fluctuations in the rotational speeds of the respective photoconductive drum drive gears 2y, 2c, 2m, and 2bk can vary depending on accuracy of tooth of the gear, the respective phases of the photoconductive drum drive gears 2y, 2c, 2m, and 2bk for stopping may also change due to each structural condition of image forming apparatuses.

The optimal position of the photoconductive drum drive gears 2y, 2c, 2m, and 2bk to move and stop at the optimal positions with the phase differences for the drum replacement corresponds to the peak positions of the fluctuations in the rotational speeds of the respective photoconductive drum drive gears 2*y*, 2*c*, 2*m*, and 2*bk*. After the photoconductive drum drive gears 2*y*, 2*c*, 2*m*, and 2*bk* stop at the respective positions, the user opens a front cover 30 and a drum supporting member 40 of the image forming apparatus 100 as shown in FIG. 10B, and then replaces a used photoconductive drum with a new photoconductive drum by matching the peak position of the new photoconductive drum with the peak position of a photoconductive drum drive gear corresponding to the new photoconductive drum. Thus, the phase relationship between the photoconductive drum 1 and the photoconductive drum drive gear 2 can be adjusted.

Further, in FIG. 10B, the image forming apparatus 100 has respective markings 50*y*, 50*c*, 50*m*, and 50*bk* indicated by arrows, so as to indicate one of the maximum and minimum peak positions of the fluctuation of the rotational speed of the photoconductive drum drive gears 2*y*, 2*c*, 2*m*, and 2*bk*, respectively. For example, the markings 50*y*, 50*c*, 50*m*, and 50*bk* can be disposed around a portion in which a photoconductive drum 1 is mounted as shown in FIG. 10B, so that a user can notice the markings 50*y*, 50*c*, 50*m*, 50*bk* when the user opens the front cover 30 of the image forming apparatus 100 to replace a used photoconductive drum to a new photoconductive drum. Thus, the change in the fluctuation of the rotational speed due to the replacement of the photoconductive drum 1 can easily be controlled.

Figure 11A:
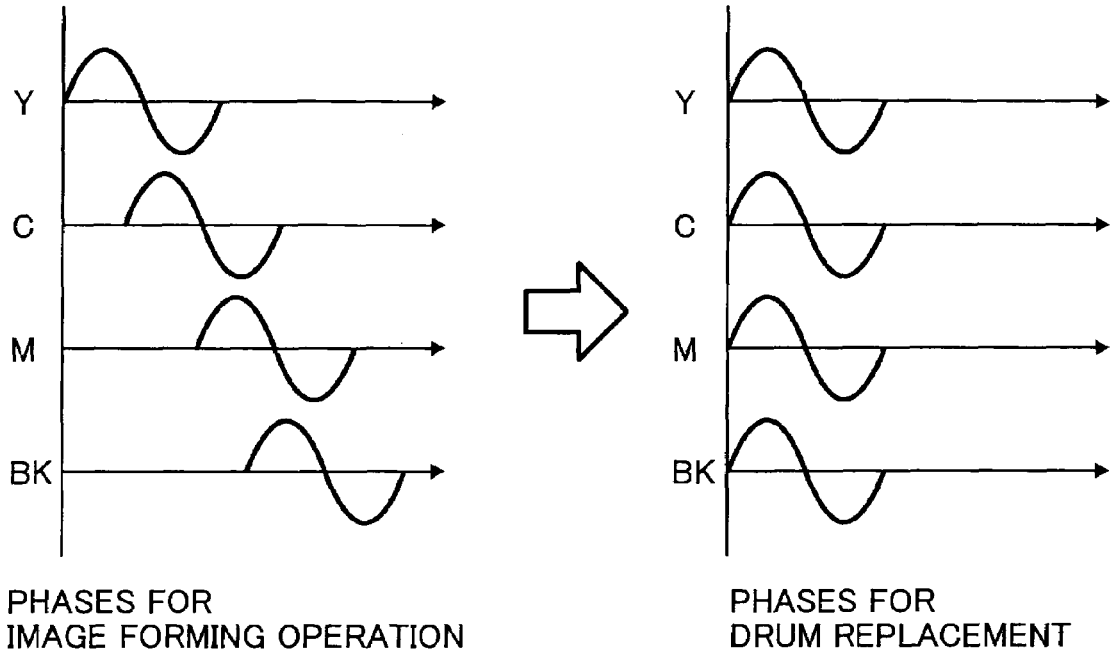
FIG. 11A shows graphs of phases of the image bearing member in an image forming operation and in a replacement of the image bearing member.
Figure 11B:
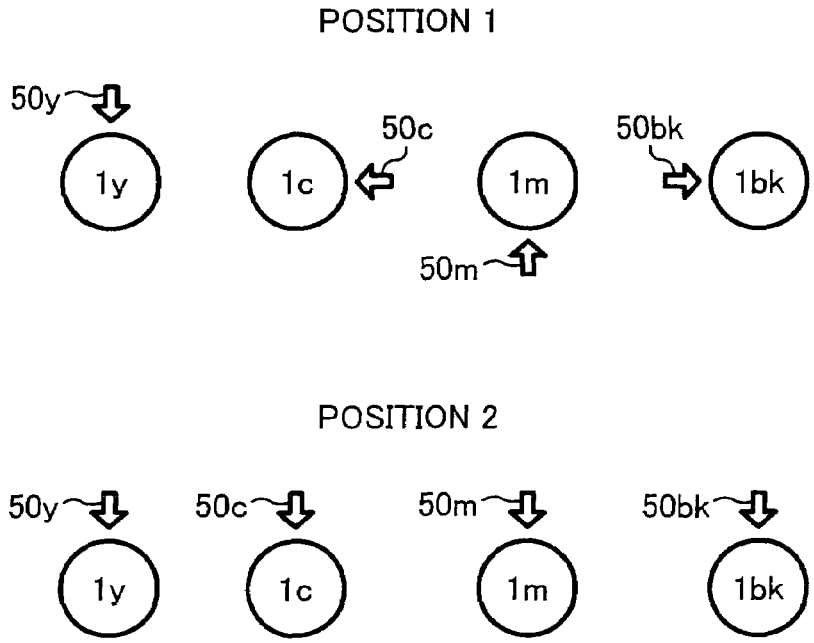
FIG. 11B shows the position of the image bearing members during image formation and replacement of the image bearing members.

Further, as shown in FIGS. 11A and 11B, the photoconductive drum drive gears 2*y*, 2*c*, 2*m*, and 2*bk* are controlled to stop at the respective positions with the phase difference for the drum replacement.

As shown in FIG. 11A, when the photoconductive drums 1*y*, l, 1*m*, and 1*bk* are used in the image forming operation, the phases of the respective photoconductive drums 1*y*, 1*c*, 1*m*, and 1*bk* are different. According to at least one embodiment of the present patent application, however, the phases of the respective photoconductive drums 1*y*, 1*c*, 1*m*, and 1*bk* become identical to each other when the image forming apparatus 100 becomes ready to replace a photoconductive drum. That is, the respective fluctuations in the respective rotational speeds of the plurality of photoconductive drum drive gears 2*y*, 2*c*, 2*m*, and 2*bk* become identical in phase to each other so that the respective fluctuations in the respective rotational speeds of the plurality of photoconductive drums 1*y*, 1*c*, 1*m*, and 1*bk* can also become in phase with the identical in phase when the photoconductive drum is replaced. Thereby, the maximum and minimum peak positions of the fluctuations of the rotational speeds of the photoconductive drums 1*y*, 1*c*, 1*m*, and 1*bk* become identical in phase as shown in FIG. 11A.

Further, as shown in FIG. 11B, positions of the markings 50*y*, 50*c*, 50*m*, and 50*bk*, indicated by the arrows in this case, may also become identical at each image forming station or unit, and the user can easily replace the photoconductive drums 1. The markings 50*y*, 50*c*, 50*m*, and 50*bk* can be provided at identical positions as shown in Position 2 of FIG. 11B and at different positions as shown in Position 1 of FIG. 11B. The positions of markings 50*y*, 50*c*, 50*m*, and 50*bk* are not limited as long as the markings 50*y*, 50*c*, 50*m*, and 50*bk* are configured to indicate the optimal engaging position for the photoconductive drums 1*y*, 1*c*, 1*m*, and 1*bk*.

Referring to FIG. 12, a schematic structure of the photoconductive drum 1 is described.

In FIG. 12, the marking 16 is mounted on the drum flange 15. The marking 16 is used to indicate one of the maximum and minimum peak positions of the fluctuation in the rotation speed of any one of the photoconductive drums 1*y*, 1*c*, 1*m*, and 1*bk*.

With the marking 16, the user can visually confirm the fluctuation in the rotational speed of the photoconductive drum 1 and that of the photoconductive drum drive gear 2 corresponding to the photoconductive drum 1 to be kept at a constant speed.

Further, it is more preferable to have markings such as the markings 50*y*, 50*c*, 50*m*, and 50*bk*, inside the image forming apparatus 100. For example, the marking 50*y* formed on the image forming apparatus 100 shown in FIGS. 10B and 11B indicates a position in which the fluctuation in the rotational speed of the photoconductive drum drive gear 2*y* comes to one of the maximum and minimum peak positions. With the above-described structure, the user can easily mount the photoconductive drum 1 by matching the marking 16 formed on the drum flange 15 and the marking 50 on the image forming apparatus 100.

Thereby, the photoconductive drums 1*y*, 1*c*, 1*m*, and 1*bk* can maintain a constant phase relationship of the fluctuation in the rotational speed with respect to the corresponding photoconductive drum drive gears 2*y*, 2*c*, 2*m*, and 2*bk*, which can reduce an amount of phase shifts before and after the replacement of a photoconductive drum. Further, with the above-described structure, the image forming apparatus 100 can produce high quality images with a smaller amount of color shifts without printing image patterns for detecting and adjusting the phases of photoconductive drums, which can reduce a waiting time for users.

Further, the fluctuation of the rotational speed caused by any one of the photoconductive drums 1*y*, 1*c*, 1*m*, and 1*bk* mounted in the image forming apparatus 100 can previously obtained in the process of assembling the image forming apparatus 100, by a measuring instrument (not shown) that is used to measure characteristic values of the photoconductive drums 1*y*, 1*c*, 1*m*, and 1*bk* and/or the photoconductive drum drive gears 2*y*, 2*c*, 2*m*, and 2*bk*, as described above. The output information, which is a specified number, from the measuring instrument about the maximum or minimum peak position of the fluctuation in the rotational speed of the photoconductive drum 1 is affixed onto a box that contains the corresponding photoconductive drum 1 or the corresponding photoconductive drum 1 itself.

The specified number corresponding to the information is attached on the box or the drum flange 15 with a tag, memo, sealing member and so forth with the information thereon so that the user can easily obtain the maximum or minimum peak position of the fluctuation in the rotational speed of each of the photoconductive drums 1*y*, 1*c*, 1*m*, and 1*bk*. The information attached to the drum flange 15 of the photoconductive drum 1 can facilitate the registration of the peak positions of the fluctuations in the rotational speeds of the photoconductive drum 1 and the photoconductive drum drive gear 2. With the above-described structure, the phase shifts before and after the replacement of any one of the photoconductive drums 1*y*, 1*c*, 1*m*, and 1*bk* can be reduced, and high quality images with less color shift can be provided without performing the phase adjustment by forming patterns on the photoconductive drums, thereby reducing the standby time for the user.

Further, as previously described, the photoconductive drum 1 can be incorporated in the process cartridge. By incorporating each of the photoconductive drums 1*y*, 1*c*, 1*m*, and 1*bk* into the corresponding process cartridge, a user can easily replace the photoconductive drum 1 without touching the photoconductive drum 1 itself, the position or the phase of fluctuation in the rotational speed of the photoconductive drum 1 is not likely to change. When the rotational phase of the photoconductive drum 1 is previously adjusted, before the shipment of the photoconductive drum 1, with respect to the peak position of the fluctuation in the rotational speed of the photoconductive drum drive gear 2 provided in the color image forming apparatus 100, the user does not have to adjust the phase of the photoconductive drum 1 when replacing the photoconductive drum 1, and quickly and easily replace the photoconductive drum 1 to the color image forming apparatus 100.

Further, as previously described, when any one of the photoconductive drums 1*y*, 1*c*, 1*m*, and 1*bk* and some other image forming components of the image forming unit are integrally formed as a detachable process cartridge, a user can smoothly replace the photoconductive drum 1 without directly touching the photoconductive drum 1 and/or changing the position of the photoconductive drum 1.

As previously described, when the photoconductive drum 1 is replaced, the photoconductive drums 1*y*, 1*c*, 1*m*, and 1*bk* are controlled to have the phase differences for the drum replacement. If the photoconductive drums 1*y*, 1*c*, 1*m*, and 1*bk*, however, are controlled to stop at the position with the phase differences for the image forming operation after each printing operation is completed, the image forming apparatus 100 adjusts the photoconductive drum 1 once again to have desired phase differences of the photoconductive drums 1*y*, 1*c*, 1*m*, and 1*bk* for the image forming operation before the start of the following printing operation. This may be a cause of a delay in the first print time of the image forming apparatus 100.

To avoid the delay, it is preferable that a user inputs instructions through the operation panel 20 on the image forming apparatus 100 so that the phase adjustment of the photoconductive drums 1*y*, 1*c*, 1*m*, and 1*bk* is performed when the photoconductive drum is replaced. This operation can make the image forming apparatus 100 smoothly perform the regular printing operation.

Further, when an operation button with instructions for the drum replacement is provided inside the front cover 30 of the image forming apparatus 100, the user can notice the instructions when replacing the photoconductive drum 1, which can prevent further deterioration in color shift caused by neglect of the phase adjustment by the user.

According to at least one embodiment of the present patent application, the image forming apparatus 100 has different phase differences of photoconductive drum drive gears 2*y*, 2*c*, 2*m*, and 2*bk* when replacing a photoconductive drum 1 and when performing the image forming operation so as to reduce color shifts caused by changes of the phases of the photoconductive drums 1*y*, 1*c*, 1*m*, and 1*bk* due to the drum replacement, thereby providing images in high quality.

By providing the marking 16 on each of the photoconductive drums 1*y*, 1*c*, 1*m*, and 1*bk* to indicate one of the maximum and minimum peak positions of the fluctuations in the rotational speeds of the photoconductive drums 1*y*, 1*c*, 1*m*, and 1*bk*, an increase of an amount of color shift caused by the replacement of a photoconductive drum can be prevented.

When any one of the photoconductive drums 1*y*, 1*c*, 1*m*, and 1*bk* are replaced, the phase differences of the photoconductive drum gears 2*y*, 2*c*, 2*m*, and 2*bk* with respect to the corresponding photoconductive drums 1*y*, 1*c*, 1*m*, and 1*bk* can be changed from the image forming position to the replacement position by a user input operation from the operation panel 20 provided to the image forming apparatus 100 or from buttons mounted on the front cover 30 of the image forming apparatus 100 or by an automatic operation along with a movement of the front cover 30. Thereby, a performance of printing a first copy can be maintained, and an increase of the amount of color shifts caused by the replacement of the photoconductive drum 1 can be prevented.

As an alternative, when the phase differences of the photoconductive drum drive gears 2*y*, 2*c*, 2*m*, and 2*bk* are controlled along with a movement of the front cover 30 of the image forming apparatus 100 when the photoconductive drum 1 is replaced, the deterioration of color shift caused by forgetting the operations may be more prevented.

The above-described embodiments are illustrative, and numerous additional modifications and variations are possible in light of the above teachings. For example, elements and/or features of different illustrative and exampley embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed is:

1. An image forming apparatus, comprising:

a plurality of image bearing members configured to bear an image on a surface thereof;

a plurality of drive members concentrically engaged with the plurality of image bearing members corresponding thereto and configured to rotate the plurality of image bearing members;

a plurality of drive sources configured to transmit driving forces respectively to the plurality of drive members; and a plurality of detecting units configured to detect positions in a direction of rotation of the plurality of drive members, the plurality of drive sources driven according to results of the positions detected by the plurality of detecting units, wherein the plurality of drive members are adjusted to have a first phase difference arranged for a replacement of the plurality of image bearing members, the first phase difference being different from a second phase difference arranged for an image forming operation.

2. The image forming apparatus according to claim 1, wherein:

the plurality of drive members correspond to the plurality of respective image bearing members;

the plurality of drive members are configured to be adjusted to have the first phase difference for the replacement and the second phase difference for the image forming operation.

3. The image forming apparatus according to claim 2, wherein the image forming apparatus includes a plurality of markings, each of which configured to indicate one of maximum and minimum peak positions of a fluctuation in a rotation speed of the plurality of drive members.

4. The image forming apparatus according to claim 2, wherein respective fluctuations in respective rotational speeds of the plurality of drive members are measured by a measuring unit before shipping.

5. The image forming apparatus according to claim 4, wherein the respective fluctuations in the respective rotational speeds of the plurality of drive members become identical in phase to each other for the replacement of the plurality of image bearing members.

6. The image forming apparatus according to claim 3, wherein the respective fluctuations in the respective rotational speeds of the plurality of image bearing members are measured by a measuring unit before shipping.

7. The image forming apparatus according to claim 6, wherein the plurality of image bearing members include respective markings, each of which configured to indicate one of maximum and minimum peak positions of a fluctuation in a rotation speed of the plurality of image bearing members.

8. The image forming apparatus according to claim 7, wherein the plurality of drive members are configured to be adjusted to have the first phase difference for the replacement such that one of the maximum and minimum peak positions of the fluctuation in the rotational speed of the plurality of drive members fits with one of the maximum and minimum peak positions of the fluctuation in the rotational speed of the plurality of image bearing members.

9. The image forming apparatus according to claim 2, wherein each of the plurality of image bearing members is included in a process cartridge corresponding thereto.

10. The image forming apparatus according to claim 1, wherein the first phase difference different from the second phase difference is selected through an operation panel provided to the image forming apparatus for the replacement of the plurality of image bearing members.

11. The image forming apparatus according to claim 1, wherein the first phase difference different from the second phase difference is selected via buttons provided inside a cover of the image forming apparatus for the replacement of the plurality of image bearing members.

12. The image forming apparatus according to claim 1, wherein the first and second phase differences are automatically changed along with a movement of a cover of the image forming apparatus for the replacement of the plurality of image bearing members.

13. An image forming apparatus, comprising:

means for bearing an image;

means for rotating the means for bearing; and means for detecting a phase of the means for rotating, wherein the means for rotating is adjusted to have a first phase difference arranged for a replacing operation different from a second phase difference for an image forming operation.

14. The image forming apparatus according to claim 13, further comprising:

first means for indicating one of maximum and minimum peak positions of a fluctuation in a rotation speed of the means for rotating; and second means for indicating one of maximum and minimum peak positions of a fluctuation in a rotation speed of the means for bearing.

15. The image forming apparatus according to claim 13, wherein the means for rotating are adjusted to have the first phase difference for the replacement such that that one of the maximum and minimum peak positions of a fluctuation in a rotational speed of the means for rotating fits with one of the maximum and minimum peak positions of a fluctuation in a rotational speed of the means for bearing.

16. A method of adjusting a phase difference of an image bearing member of an image forming apparatus, comprising:

opening a cover of the image forming apparatus;

rotating a plurality of drive members to adjust a first phase difference thereof arranged for a replacement of the image bearing member;

replacing the plurality of image bearing members with a plurality of new image bearing members;

closing the cover of the image forming apparatus; and changing the drive member to adjust a second phase difference thereof arranged for an image forming operation.

17. The method according to claim 16, wherein the rotating and changing steps comprises at least one of:

controlling the phase difference through an operation panel provided to the image forming apparatus;

controlling the phase difference through buttons provided inside the cover of the image forming apparatus; and automatically changing the phase difference with a movement of the cover of the image forming apparatus.

* * * * *